US006396901B1

(12) United States Patent
Hell et al.

(10) Patent No.: US 6,396,901 B1
(45) Date of Patent: May 28, 2002

(54) X-RAY EMITTER WITH FORCE-COOLED ROTATING ANODE

(75) Inventors: Erich Hell; Wolfgang Knüpfer; Detlef Mattern, all of Erlangen; Peter Schardt, Höchstadt A.D. Aisch, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/889,898

(22) PCT Filed: Nov. 22, 2000

(86) PCT No.: PCT/DE00/04126

§ 371 (c)(1),
(2), (4) Date: Jul. 24, 2001

(87) PCT Pub. No.: WO01/39557

PCT Pub. Date: May 31, 2001

(30) Foreign Application Priority Data

Nov. 24, 1999 (DE) ..... 199 56 491

(51) Int. Cl.[7] ..... H01J 35/10
(52) U.S. Cl. ..... 378/130; 378/141; 378/200
(58) Field of Search ..... 378/130, 127, 378/141, 200, 199

(56) References Cited

U.S. PATENT DOCUMENTS 4,418,421 A 11/1983 Kitadate et al.
4,734,927 A 3/1988 Leguen et al.
4,768,212 A 8/1988 Appelt et al.
4,788,705 A 11/1988 Anderson
5,541,975 A * 7/1996 Anderson et al. ..... 378/130
6,041,100 A 3/2000 Miller et al.
6,084,942 A 7/2000 Hell et al.

* cited by examiner

*Primary Examiner*—David P. Porta
*Assistant Examiner*—Elizabeth Gemmell
(74) *Attorney, Agent, or Firm*—Young & Thompson

(57) ABSTRACT

An X-ray source is proposed having a rotating piston tube (2) which is mounted such that it can rotate, in which a stationary guide body (12), which at least partially surrounds the tube, is provided for cooling the anode plate (4). The guide body (12) is designed such that a liquid coolant, which is supplied to the tube (2) from a reservoir (15) concentrically with respect to the anode-bearing shaft (17), is initially positively guided along the tube outside of the anode plate (4) and along the beam outlet window (20) of the tube forming narrow gaps (18, 19), and is then passed out radially via at least one baffle plate (21) which is arranged on the tube (2) and engages in a correspondingly designed gap in the guide body (12). The high-voltage parts have an insulating gas applied to them, which is physically not separated from the liquid coolant in the source housing (1).

8 Claims, 1 Drawing Sheet

X-RAY EMITTER WITH FORCE-COOLED ROTATING ANODE

Figure 1:
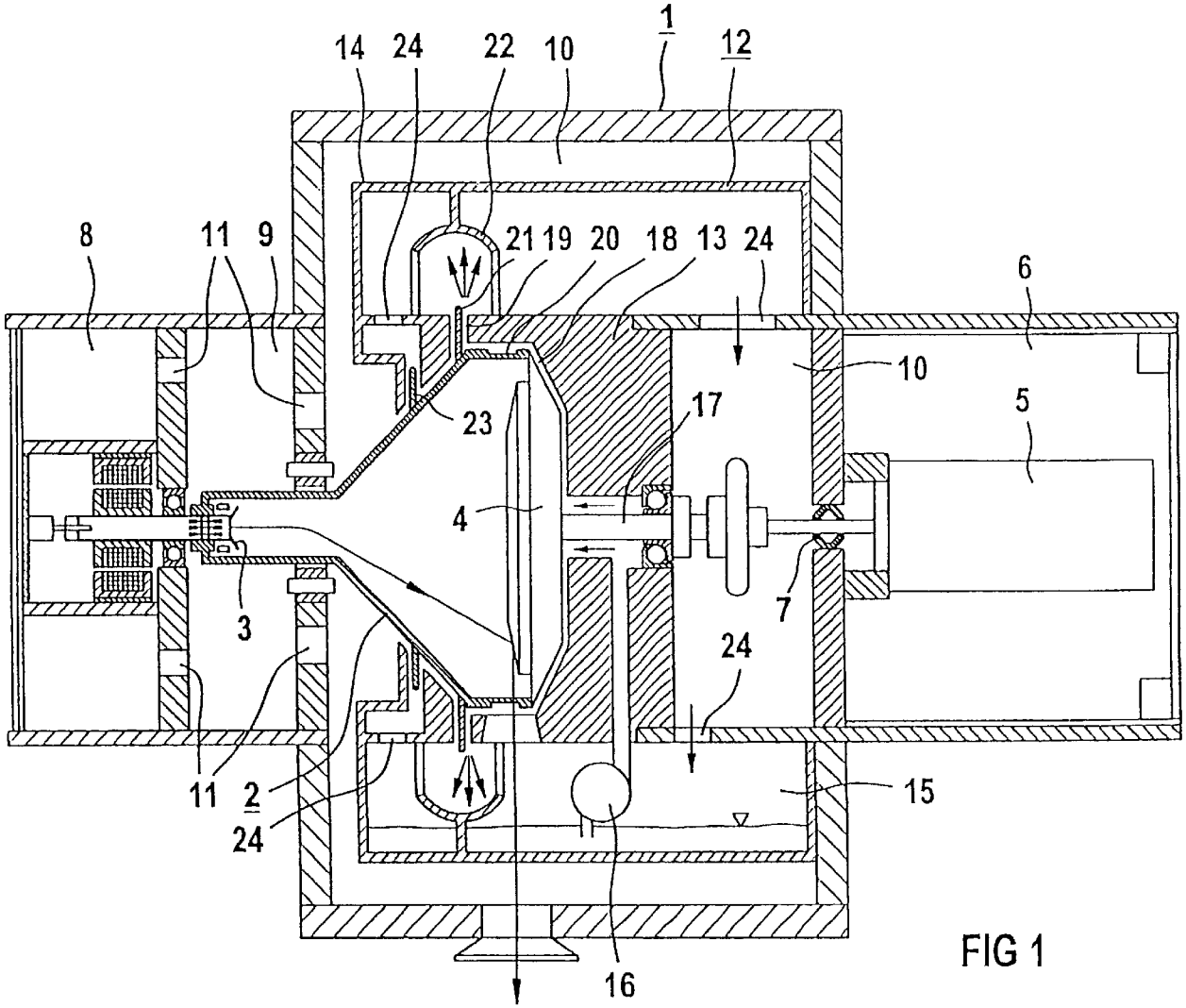

The invention relates to an X-ray source having positively cooled rotating anode, as claimed in the precharacterizing clause of patent claim 1.

In X-ray tubes based on rotating piston tubes, the entire tube is mechanically kept rotating quickly, and the electron beam is mechanically fixed on the focus. The space between the tube and source housing in such known X-ray tubes (DE 197 41 750 A1) is filled with a suitable liquid coolant, generally oil. The oil filling is used firstly to dissipate the amount of heat produced at the anode, and secondly to provide sufficient isolation for the high voltages, positive on the anode and negative on the cathode, from the source housing, which is at ground potential. Such a closed system with a global oil filling results in a number of problems.

Firstly, the rotation power that needs to be used for the rotation speeds that are required nowadays (>100 revolutions per second) are considerable owing to the very high friction losses; if at all, such power can be reduced only by comparatively high design complexity. Secondly, the oil filling must be introduced into the tube housing very carefully in order to avoid the formation of bubbles. This is because, during tube operation, the formation of vapor bubbles due to cavitation in the isolation area can lead to considerable problems in terms of the ability to withstand high voltages. The dissipation of heat losses from the rotating anode is also problematic.

The known X-ray source which has been mentioned above attempts to solve this problem by providing an external heat exchanger for cooling down the oil and by arranging the inlet and outlet for the oil at points on the source housing at which a reduced pressure or increased pressure is produced by the rotation of the rotating piston.

A rotating piston tube whose anode is provided with ribs on its outside is known from DE 8 713 042 U1. A coolant, in particular a liquid coolant, is applied to the outside of the anode.

As an alternative to cooling the anode using oil, it is also known for the anode to be cooled using a cooling gas, in which case the tube can be provided on its outside with circular ribs to improve the heat dissipation, and these can also be used at the same time for the tube drive (EP 0 187 020 B1).

In conjunction with an X-ray tube having a fixed anode, U.S. Pat. No. 4,418,421 refers to a prior art which states that gas cooling using sulfur hexafluoride (SF6) can be provided, instead of oil cooling of the anode, in order to save weight. However, it is regarded as a disadvantage of such designs that the comparatively large amount of heat produced in particular from high-power tubes in the range from 70 to 100 kV can lead to a reduction in the insulation capability of the gas.

The cited US Patent Specification also refers to a further prior art, which states that the two media, oil and gas, can be physically separated and the X-ray tube can be accommodated in a first housing filled with oil, with the high-voltage parts being arranged in a second housing in which the gas filling is introduced. Although the two separate housings are electrically and mechanically connected to one another, the two media are arranged such that they are isolated from one another. However, any design for this purpose is comparatively complex.

The invention specified in patent claim 1 is based on the object of specifying an X-ray source of the type mentioned initially which allows the disadvantages of the known X-ray sources to be avoided. In particular, the X-ray source is intended to ensure reliable isolation of the high-voltage parts irrespective of the rotation speed and to have low friction losses, so that the X-ray tube can be operated at a higher rotation speed and with less friction losses than in the past.

According to the invention, the functions of electrical isolation and cooling of the anode are separated, but without having to physically separate from one another the two media provided for this purpose in the tube housing. The insulating gas is incorporated in the source housing such that it is not physically separated from the cooling routing.

In order to achieve approximately the same isolation capability as with oil, the high-voltage parts advantageously have sulfur hexafluoride (SF6) applied to them at a gas pressure of approximately 3 bar. In these conditions, the gas is an excellent insulator, and is chemically completely inert up to several hundred degrees Celsius.

The coolant is cooled in an open cooling system so that there is no need for any expansion vessel and the exchange between the tube and coolant is simplified. Oil is preferably used for cooling the thermally highly loaded anode plate and is supplied, by a feed pump, from a reservoir concentrically with respect to the bearing shaft of the anode, is then first of all positively guided via narrow gaps along the tube outside of the anode plate and along the beam outlet window, and is then passed out radially into the source housing via a baffle plate, or possibly a number of baffle plates, which is or are arranged on the tube. The reservoir is advantageously arranged inside the source housing and is in the form of an open sump. Together with the feed pump, the sump can also be arranged outside the source housing, and may be in the form of a heat exchanger.

One major advantage of the arrangement according to the invention is that the X-ray source has only a fraction of the friction losses known from previous sources, so that the tube can be operated with reduced friction losses at comparatively high rotation speeds.

The guide body, which is arranged fixed in the source house, can advantageously be at least partially formed by walls of the source housing itself, provided the design conditions allow. In order to optimize the way in which the coolant, which is sprayed out on the baffle plate, is carried away, the guide body can be provided with a shroud-like guidance element, which advantageously has a semicircular cross section. If necessary, there may be a number of baffle plates on the rotating piston tube, engaging like laminates in the stationary guide body. The baffle plates or roe laminates are advantageously at least partially composed of elastic material, and the elastic parts rest axially and/or radially on the corresponding surfaces of the guide body. This ensures that as little coolant as possible can enter the remaining part of the source housing. The baffle plates, which are provided like laminates, need provide only sealing against oil spray.

The cooling system is advantageously in the form of an open cooling system, with oil preferably being used as the coolant which, using a pump, is first of all passed with positive guidance from an open oil sump to the parts to be cooled, and then flows back into the oil sump again without positive guidance.

Figure 2:
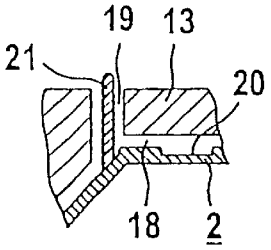

An exemplary embodiment of the invention will be explained in more detail below in the following text with reference to the drawing, in which:

FIG. 1 shows a longitudinal section through one embodiment of an X-ray source, and FIG. 2 shows a detail from FIG. 1, illustrated enlarged.

FIG. 1 shows a simplified illustration of one embodiment of an X-ray source according to the invention, in the form of a longitudinal section. A rotating piston tube 2 is mounted in a known manner such that it can rotate in a source housing, which is annotated 1 overall, with the cathode of the rotating piston tube 2 being annotated 3, and its anode plate being annotated 4. The rotating piston tube 2 is driven by means of a motor 5, which is arranged in a first housing chamber 6. The housing chamber 6 is protected against the ingress of oil and gas in the region of the drive shaft by means of a sealing ring 7.

Further housing chambers are annotated 8, 9 and 10 and these are not sealed from one another, that is to say they are open to one another. Appropriate openings 11 can be provided in the housing walls for this purpose.

A stationary guide body 12 is located in the housing chamber 10 and is arranged essentially around the rotating piston tube 2 in the region of the anode plate 4. The guide body 12 is partially formed by walls 13 of the housing 1 or of the housing chamber 10, with the rest of it being formed by a separate, integral or multi-piece molding 14. The parts are designed such that an open sump 15 to hold cooling oil is formed underneath the tube, and there is sufficient space to accommodate a feeder pump 16. The guide body 12 is furthermore designed such that the oil carried from the sump 15 by the feed pump 16 is first of all supplied concentrically with respect to the bearing shaft 17 on the anode side to the rotating piston tube 2 and then, forming a narrow gap 18 of about 1 to 10 mm, is positively guided along the tube outside of the anode plate 4 and of the circumferential beam outlet window 20. Immediately after this, the oil strikes a first baffle plate 21, which is arranged on the tube and diverts the oil, carrying it away radially via a gap 19 outward into the housing (see also FIG. 2). The oil forced out at the outlet point is caught by a shroud-like guidance element 22 which is arranged on the guide body 12 and has a semicircular cross section. The guidance element 22 is used primarily for spray protection and is intended to prevent the housing chamber 10 and the adjacent chambers from being sprayed on in an uncontrolled manner.

If necessary, as shown in FIG. 1, a second baffle plate 23 can be provided on the rotating piston tube. The two baffle plates 21 and 23 engage in the guide body 12 like laminates. At least the three ends of the baffle plates are composed of elastic material and rest lightly on corresponding surfaces of the guide body. In this way, little oil can penetrate into the remaining part of the source housing. The friction losses can thus be kept low.

After striking the guidance element 22 the oil flows back into the sump 15 without any positive guidance. Appropriate openings or recesses 24 can be provided at suitable points in the guide body 12 for this purpose.

As already mentioned, the cooling system, which operates in the form of pressure circulation lubrication, does not require an expansion vessel, as in the case of known tube cooling systems. The oil reservoir (sump 15) can be kept relatively small. The reservoir can also advantageously be designed as an external heat exchanger and can be arranged such that the feed pump, which is likewise arranged externally, cannot suck in any gas. Such sucking in of gas must be avoided in order to prevent local overheating of the anode plate and of the beam outlet window, with oil being baked on.

The insulation of the high-voltage parts, which are not shown in detail here and are arranged primarily in the housing chambers 8 and 9, is generally carried out by pressure-filling with gas, preferably with sulfur hexafluoride (SF6). In order to achieve at least the same isolation capability as with oil, the gas pressure is set to approximately 3 bar.

What is claimed is:

1. An X-ray source having a positively cooled rotating anode comprising a rotating piston tube (2), which is mounted such that it can rotate in a source housing (1), whose anode plate (4) is cooled on the outside of the tube by means of a liquid coolant, and whose high-voltage parts are electrically isolated by a gaseous medium, in which case a stationary guide body (12) which at least partially surrounds the rotating piston tube (2) in the region of the anode plate (4), is arranged in the source housing (1) and is designed in such a manner that the coolant, which is supplied concentrically to the anode-side bearing shaft (17) of the tube (2) from a reservoir (15), is initially positively guided along the tube outside of the anode plate (4) and along the beam outlet window (20) of the tube forming narrow gaps (18, 19), and is then passed out radially via at least one baffle plate (21) which is arranged on the tube (2) and engages in a correspondingly designed gap in the guide body (12), and in which case the insulating gas is incorporated in the source housing (1) such that it is physically not separated from the routing of the liquid coolant.

2. The X-ray source as claimed in patent claim 1, characterized in that the guide body (12) is at least partially formed by walls (13) of the source housing (1) itself.

3. The X-ray source as claimed in patent claim 1, characterized in that the guide body (12) has a shroud-like guidance element (22) for the coolant in the area where the coolant is passed out.

4. The X-ray source as claimed in patent claim 3, characterized in that the guidance element (22) is semicircular.

5. The X-ray source as claimed in patent claim 1, characterized in that a number of baffle plates (21) are provided on the rotating piston tube (2).

6. The X-ray source as claimed in patent claim 1, characterized in that the baffle plate (21) is at least partially composed of elastic material, and the elastic parts rest axially and/or radially on surfaces of the guide body (12).

7. The X-ray source as claimed in patent claim 1, characterized in that the coolant reservoir (15) is in the form of an open sump and is arranged inside the source housing (1).

8. The X-ray source as claimed in patent claim 1, characterized in that the coolant reservoir (15) is in the form of a heat exchanger, and is arranged outside the source housing (1).

* * * * *